US005402562A

United States Patent [19]

Saito et al.

[11] Patent Number: 5,402,562

[45] Date of Patent: Apr. 4, 1995

[54] DEVICE FOR REMOVING METAL TERMINAL

[75] Inventors: Toshimasa Saito; Akira Kato, both of Shizuoka; Masanori Chiba, Miyagi, all of Japan

[73] Assignee: Yazaki Corporation, Tokyo, Japan

[21] Appl. No.: 13,217

[22] Filed: Feb. 1, 1993

Related U.S. Application Data

[63] Continuation of Ser. No. 783,895, Oct. 29, 1991, abandoned.

[30] Foreign Application Priority Data

May 13, 1991 [JP] Japan ..... 3-107080

[51] Int. Cl.[6] ..... H01R 43/00

[52] U.S. Cl. ..... 29/764; 29/235; 29/758

[58] Field of Search ..... 29/764, 758, 235, 270, 29/825, 426.6

[56] References Cited

U.S. PATENT DOCUMENTS 3,087,235 4/1963 Porter ..... 29/764
3,222,766 12/1965 Camargo ..... 29/764
3,224,082 12/1965 Moulin ..... 29/764
3,789,484 2/1974 Morgan .
4,397,517 8/1983 Shaffer .

FOREIGN PATENT DOCUMENTS 59-36863 10/1984 Japan .

*Primary Examiner*—Carl E. Hall
*Attorney, Agent, or Firm*—Sughrue, Mion, Zinn, Macpeak & Seas

[57] ABSTRACT

A driving slope of a disengaging member of a terminal removing jig is pushed into a gap between an electric contact portion of a metal terminal and a disengaging free end part of a cantilever-like flexible engagement portion of a connector housing so that the engagement part of the flexible engagement portion is pushed up. The jig is then pushed inward further so that a butting surface of a pushing member of the jig is put into contact with the front end of the electric contact portion of the terminal to move it back out of the connector housing. Therefore, it is possible to dispense with pulling out a metal terminal from a connector housing with a hand, to make it easier to remove the terminal from the housing out of it.

11 Claims, 7 Drawing Sheets

DEVICE FOR REMOVING METAL TERMINAL

This is a Continuation of application Ser. No. 07/783,895, filed Oct. 29, 1991, now abandoned.

BACKGROUND OF THE INVENTION

The present invention relates to a connector for connecting wire harnesses provided in an automotive vehicle or the like, and more particularly, to method and device for removing a metal terminal retained in a housing of the connector therefrom.

FIG. 8 shows a male connector housing a, a female metal terminal b, and a conventional jig c for removing the terminal from the housing. The connector housing a includes a flexible engagement portion a2 projecting forward as a cantilever into a terminal chamber a1 of the housing, and a stopper a3 provided at the front end of the housing. The metal terminal b includes a female electric contact portion b1 at the front end of the terminal, and an electric wire connecting portion b2 at the rear end of the terminal. An electric wire d is coupled to the terminal b. The jig c includes a holding portion c1, and a pushing-up portion c3 extending from the holding portion and having a sharp-edged end part c2 whose height gradually decreases toward the front end of the pushing-up portion. As shown in FIG. 9, the metal terminal b is fixedly supported in the terminal chamber a1 of the connector housing a in such a manner that the electric contact portion b1 of the terminal is engaged at the front end of the portion with the stopper a3 of the connector housing and engaged at the shoulders of the rear end of the contact portion with the engagement part a4 of the flexible engagement portion a2 of the connector housing. To remove the metal terminal b from the connector housing a, the housing is held with a hand, and the jig c is held at the holding portion c1 thereof with another hand and inserted into the terminal chamber a1 of the housing from the front end thereof so that the sharp-edged end part c2 of the pushing-up portion c3 of the jig is pushed into the gap between the inner surface of the bottom part of the electric contact portion b1 of the terminal and the bottom of the engagement part a4 of the engagement portion a2 of the housing to move the engagement portion to disengage it from the terminal. After that, the hand holding jig c is moved to hold the connector housing a as well as the jig, and the other hand is moved off the housing and caused to pull the electric wire d to remove the terminal b from the housing. This conventional art was disclosed in the Japanese Utility Model Examined Publication No. Sho. 59-36863.

In the conventional art, three steps of operation, which are supporting the connector housing a, manipulating the jig c and pulling the electric wire d away from the connector housing, need to be done by both the hands. For that reason, it is relatively troublesome to remove the metal terminal b from the connector housing a. This is a problem. Further, the flexible engagement portion a2 of the housing a is likely to be damaged by the jig c. This is also a problem.

SUMMARY OF THE INVENTION

The present invention was made in order to solve the above-mentioned problems.

Accordingly, it is an object of the present invention to provide such a terminal removing jig that pulling out a metal terminal from a connector housing with a hand is dispensed with to make it easier to remove the terminal from the housing out of it, and the flexible engagement portion of the housing is not damaged during the removal.

In order to attain the above-noted and other objects, the present invention provides a device for removing a metal terminal retained in a connector housing by a flexible engagement piece therefrom, comprising: means for disengaging the flexible engagement piece from the metal terminal, having a disengaging member; means for depressing the metal terminal, having a pushing member; and support means for supporting the disengaging member and the pushing member so as to allow the disengaging member and the pushing member to be mutually moved.

The present invention also provides a method for removing a metal terminal, which is retained in a connector housing by a flexible engagement piece, therefrom using a device having disengaging and pushing members mutually movable, comprising the steps of: inserting the disengaging members into a space between the metal terminal and the connector housing; disengaging the flexible engagement piece from the metal terminal by the disengaging means; and moving the pushing member to depress the metal terminal in a state that the flexible engagement piece is disengaged from the metal terminal by the disengaging member.

DETAILED DESCRIPTION OF THE PREFERRED EMBODIMENTS

Figure 1:
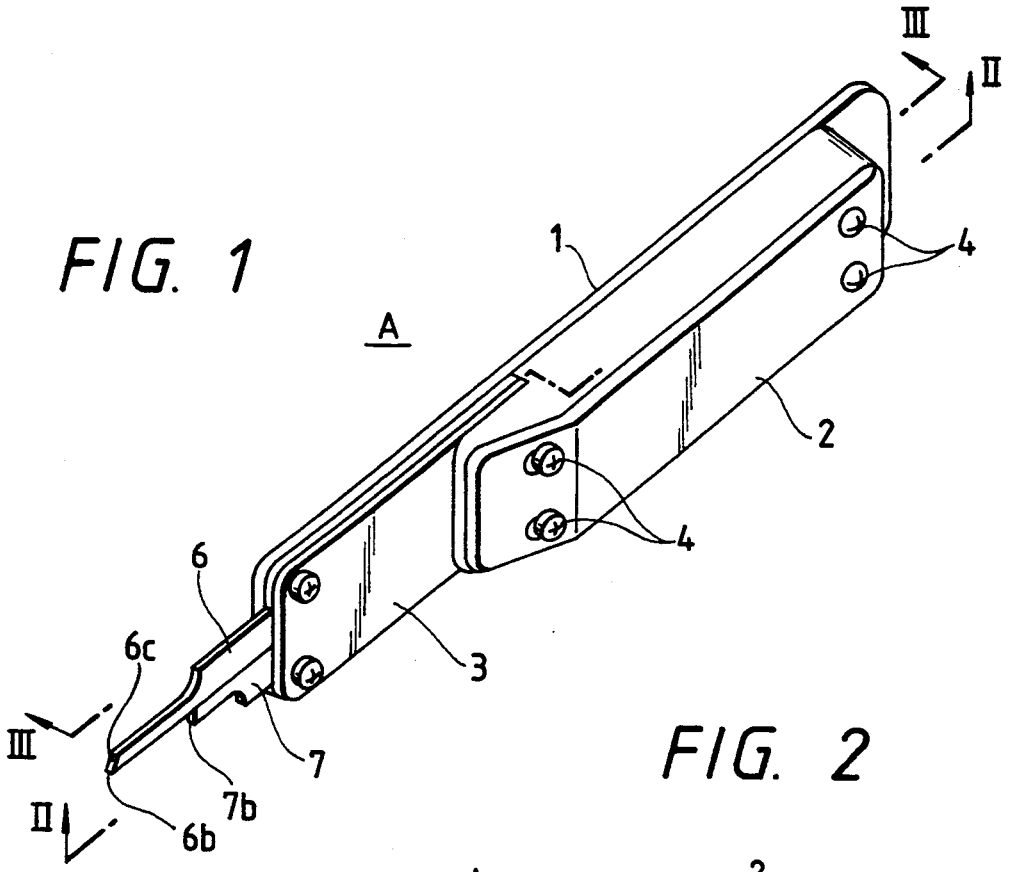
FIG. 1 is a perspective view of a jig which is an embodiment of the present invention.
Figure 2:
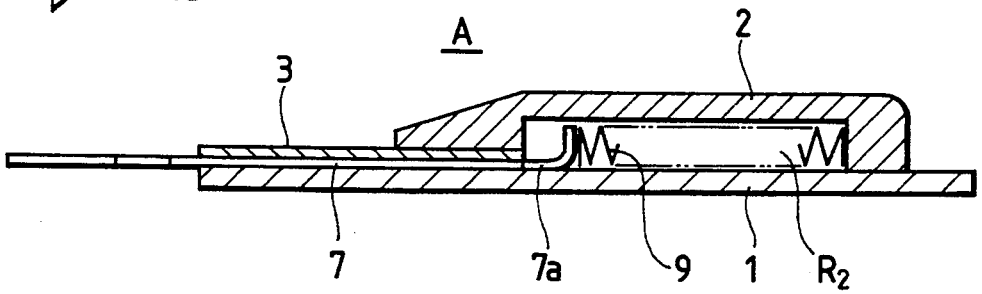
FIG. 2 is a sectional view of the jig along line II—II shown in FIG. 1.
Figure 3:
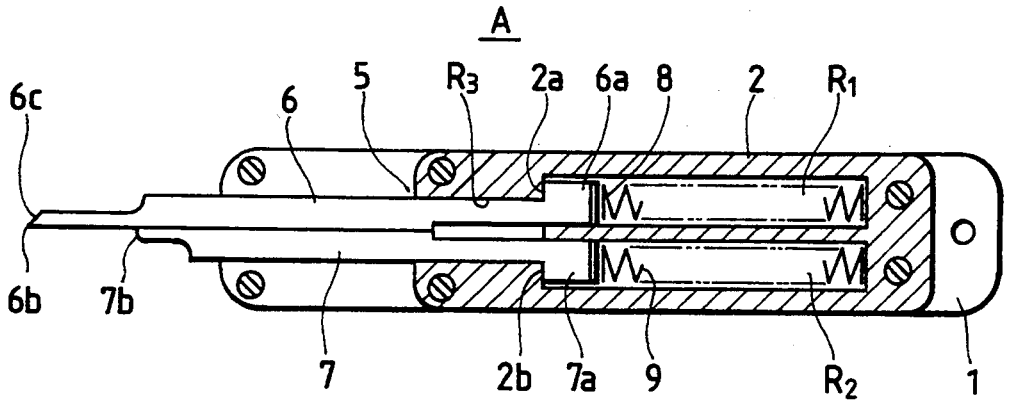
FIG. 3 is a sectional view of the jig along line III—III shown in FIG. 1.

FIGS. 1, 2 and 3 show a jig A according to an embodiment of the present invention. The jig A is used for removing a female metal terminal from a connector housing retaining the female terminal. The jig A includes a main plate 1, a grasped cover 2, a fastening plate 3, and screws 4 for securing the cover and the fastening plate to the main plate. The main plate 1, the grasped cover 2 and the fastening plate 3 constitute the holding portion of the jig A. The interior of the cover 2 is divided into individual chambers R1 and R2 and a common chamber R3.

The jig A also includes a disengaging member 6, a pushing member 7, and buffer springs 8 and 9 which are helical springs. The disengaging member 6 is for disengaging the flexible engagement portion 11 of the connector housing B, and is slidably fitted in the grasped cover 2 in such a manner that the disengaging member extends in the individual chamber R1 and the common chamber R3 and projects outward through the open end 5 of the cover. The pushing member 7 is slidably fitted in the cover 2 in such a manner that the pushing member extends in the other individual chamber R2 and the common chamber R3, and projects outward through the open end 5 of the cover. The disengaging member 6 and the pushing member 7 are urged forward by the springs 8 and 9 so that the engagement portions 6*a* and 7*a* of the members, which are located at the rear ends of the members, are usually butted to the steps 2*a* and 2*b* of the cover, respectively. The slender disengaging member 6 has a driving slope 6*c* at the front end of the member, and a sharp edge 6*b* on the end. The front end of the slender pushing member 7 constitutes a butting surface 7*b* located behind the driving slope 6*c*.

Figure 4:
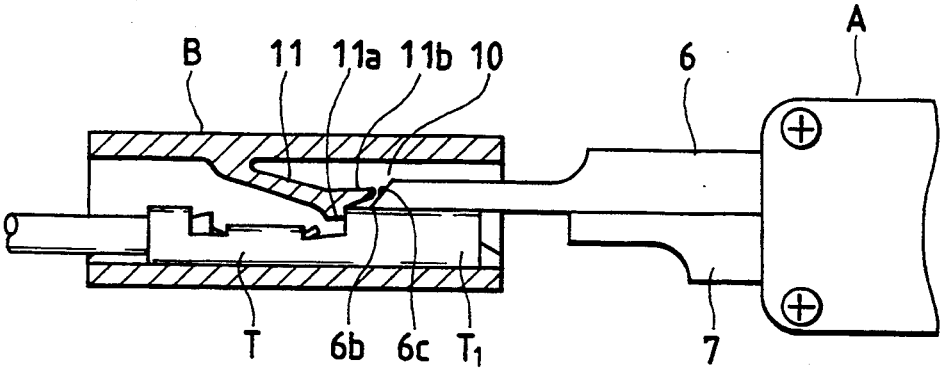
FIG. 4 is a sectional view to illustrate a step of the removal of a metal terminal with the jig.
Figure 5:
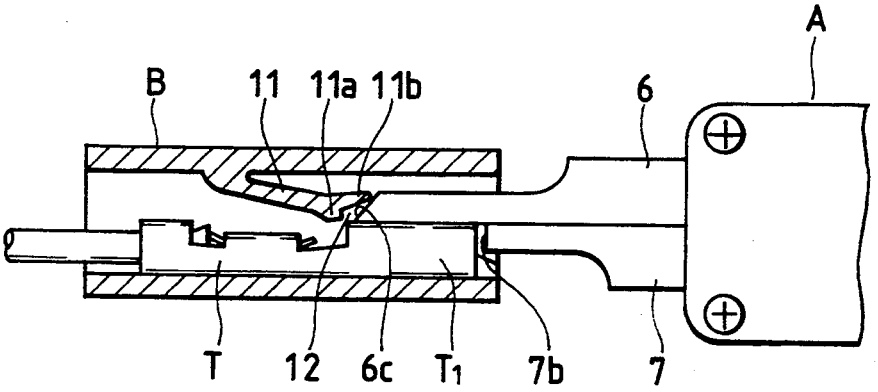
FIG. 5 is a sectional view to illustrate another step of the removal.
Figure 6:
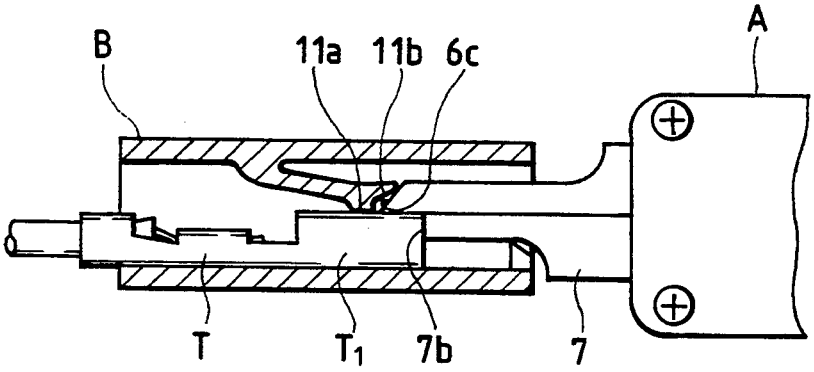
FIG. 6 is a sectional view to illustrate yet another step of the removal.

To remove the metal terminal T from the connector housing B out of it, the jig A is held with a hand, the connector housing is held with another hand, and the disengaging member 6 of the jig is inserted into the space 10 between the terminal and the housing from the front end of the housing and slide on the top of the electric contact portion T1 of the terminal, as shown in FIG. 4, so that the sharp edge 6*b* and driving slope 6*c* of the disengaging member are pushed into the gap 12 between the electrical contact portion T1 and the disengaging free end part 11*b* of the cantilever-like flexible engagement portion 11 of the connector housing to move the disengaging member back while compressing the buffer spring 8 and pushing up the engagement part 11*a* of the flexible engagement portion, as shown in FIG. 5. The disengaging member 6 of the jig A is then inserted further in the connector housing B to put the butting surface 7*b* of the pushing member 7 into contact with the front end of the electric contact portion T1 of the terminal T so that the pushing member is moved back while compressing the other buffer spring 9 but pushes the terminal back out of the connector housing B, as shown in FIG. 6.

Figure 7:
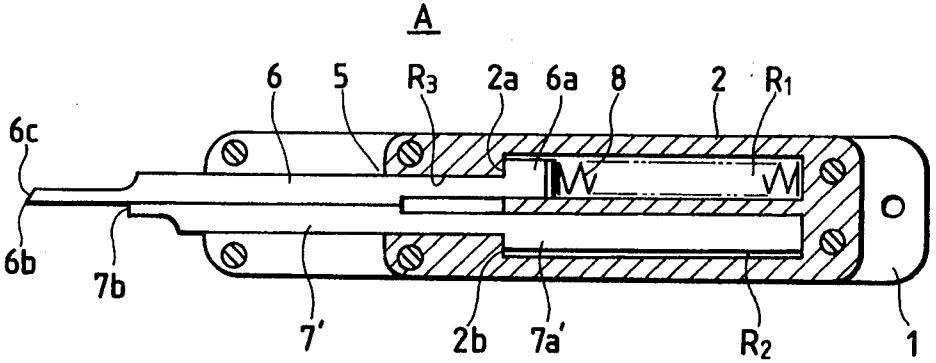
FIG. 7 is a sectional view of a jig which is another embodiment of the present invention.
Figure 8:
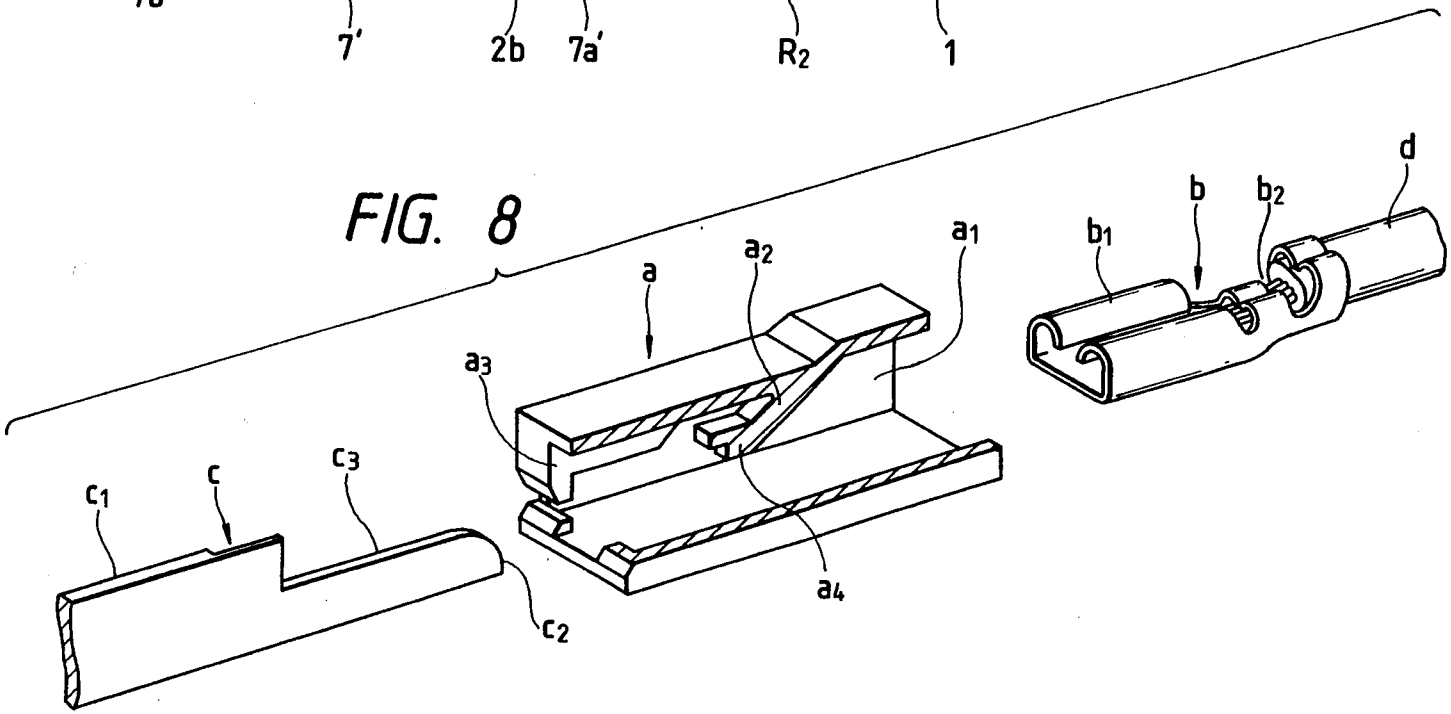
FIG. 8 is a perspective view of a conventional jig.
Figure 9:
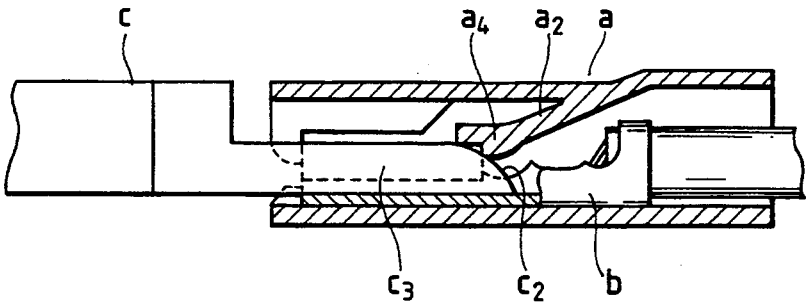
FIG. 9 is a sectional view to illustrate the removal of a metal terminal with the conventional jig.

FIG. 7 shows a jig according to another embodiment of the present invention and is for removing a metal terminal from a connector housing. The difference of the jig from the preceding one is that the engagement portion 7*a*′ of the pushing member 7′ of the jig shown in FIG. 7 is so long as to extend the full length of the individual chamber R2 and is unremovably fixed thereto.

According to the present invention, the disengaging member of the terminal removing jig is put into contact with the flexible engagement portion of the connector housing to disengage the portion from the metal terminal while being moved back against the force of the buffer spring. The pushing member of the jig is then put into contact with the terminal to push it out of the connector housing. Therefore, it is not necessary to hold an electric wire with a hand in removing a metal terminal from a connector housing out of it. For that reason, it is easier to remove the terminal from the housing out of it. Besides, helical buffer springs prevent a disengaging member and a pushing member from sharply colliding against the connector housing and the metal terminal to damage them.

Figure 10:
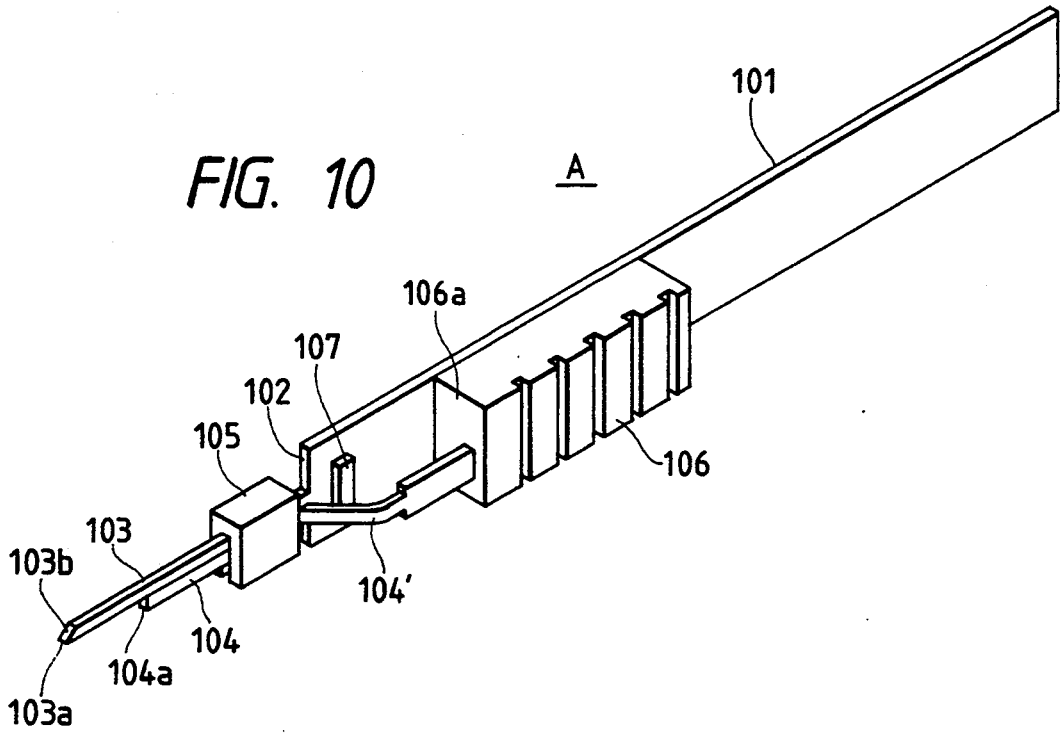
FIG. 10 is a perspective view of a jig which is yet another embodiment of the present invention.

FIG. 10 shows a jig A according to yet another embodiment of the present invention. The jig A includes a plate-like holder portion 101. The holder portion 101 is formed with a step portion 102 to provide at the front part thereof a disengaging member 103 which is integral with the holder portion. The bar-like disengaging member 103 is provided at the front end portion thereof with a tapered driving surface 103*b* having an sharp edge 103*a*.

A slider 105 is slidably fitted to the disengaging member 103. The slider supports a pushing member 104, which is movable along the disengaging member 103 together with the slider 105 so as to depress a bar-like metal terminal retained in the connector housing. The pushing member 104 is formed at its front end with a butting surface 104*a*. The rear portion of the pushing member 104, which extends rearward from the slider 105, is bent so as to constitute an elastic connecting portion 104′ which is connected to an manipulation member 106. The manipulation member 106 is slidable relative to the holder portion 101 and is kept in pressure contact with the holder portion 101.

A stopper 107 is provided on the front portion of the holder portion 101 and a contacting surface 106*a* is formed on an entire front end of the manipulation member 106 so that the stopper 107 and the contacting surface 106*a* regulate the slidable movement of the manipulation member 106 relative to the holder portion 101.

The jig A thus constructed is operated in such a manner that the manipulation member 106 is moved by a thumb of operator's hand grasping the holder portion 101 with the other four fingers for moving the pushing member 104 relative to the disengaging member 103. In this operation, the pushing member 104 can be moved from a position at Which the slider 105 abuts the step portion 102 and to a position at which the contacting portion 106*a* of the manipulation member 106 abuts the stopper 107.

Figure 11A:
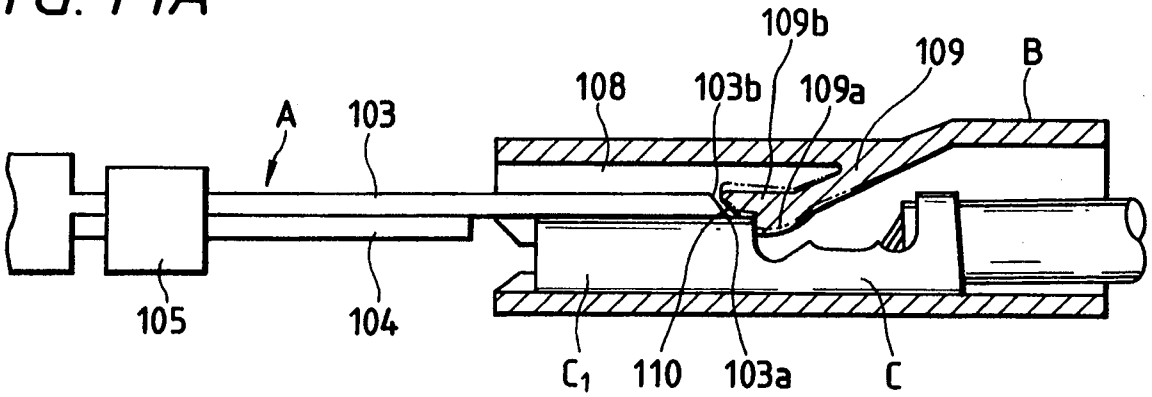
FIGS. 11A and lib are sectional views to illustrate steps of the removal of a metal terminal with the jig shown in FIG. 10.
Figure 11B:
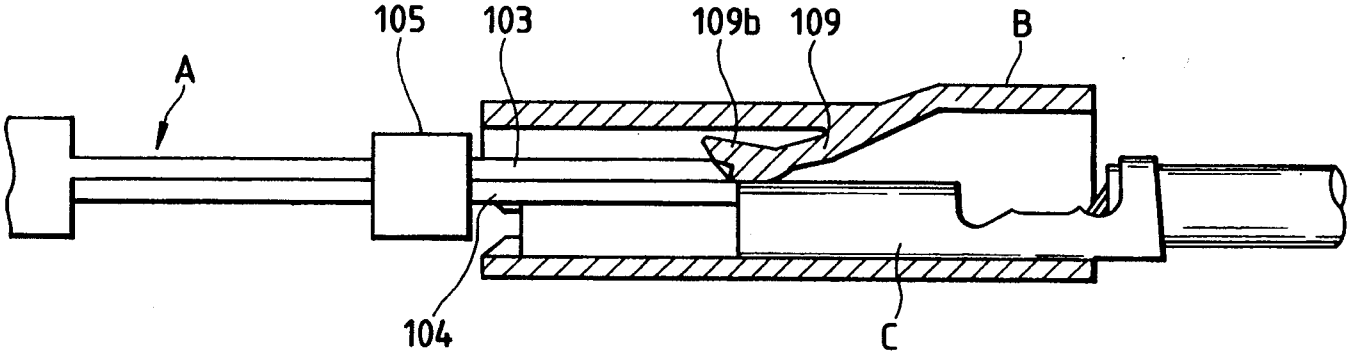

In use, the jig A is held with one hand while the connector housing B is held with the other hand, and the disengaging member 103 is inserted from a mating side of the connector housing B into a space between the connector housing B and the female metal terminal C retained in the connector housing B in a state that the pushing member 104 is kept backward. Then, the disengaging member 103 is further inserted into the space so as to slide along and on an electric contact portion C1 of the metal terminal C. Therefore, the sharp edge 103*a* and the tapered driving surface 103*b* are depressingly inserted into a gap 110 between the electric contact portion C1 and a disengaging part 109*b* provided at an free end of the cantilever-like flexible engagement piece 109. As a result, an engagement part 109*a* of the flexible engagement piece 109 is pushed up through the driving surface 103*b* and the disengaging part 109*b* so as to be disengaged from the rear end of the electric contact portion C1, as shown in FIG. 11A. In this state, the pushing member 104 is manipulated to depress the front end of the electric contact portion C1 through the butting surface 104*a*. As a result, the metal terminal C slides relative to the connector housing B while being kept in contact with the pushing member 104, so that the metal terminal C can be removed from the connector housing B, as shown in FIG. 11B.

In addition, even if the gap 110 is not formed between the electric contact portion C1 and the flexible engagement piece 109, by the virtue of the sharp edge 103*a* it is possible to disengage the engagement part 109*a* from the electric contact portion C1 when the disengaging member 103 is forcibly depressed to the flexible engaging piece 109.

The pushing member 104 is returned to an original position, i.e. the backward position, through the manipulation member 106 for a next removal operation.

Figure 12:
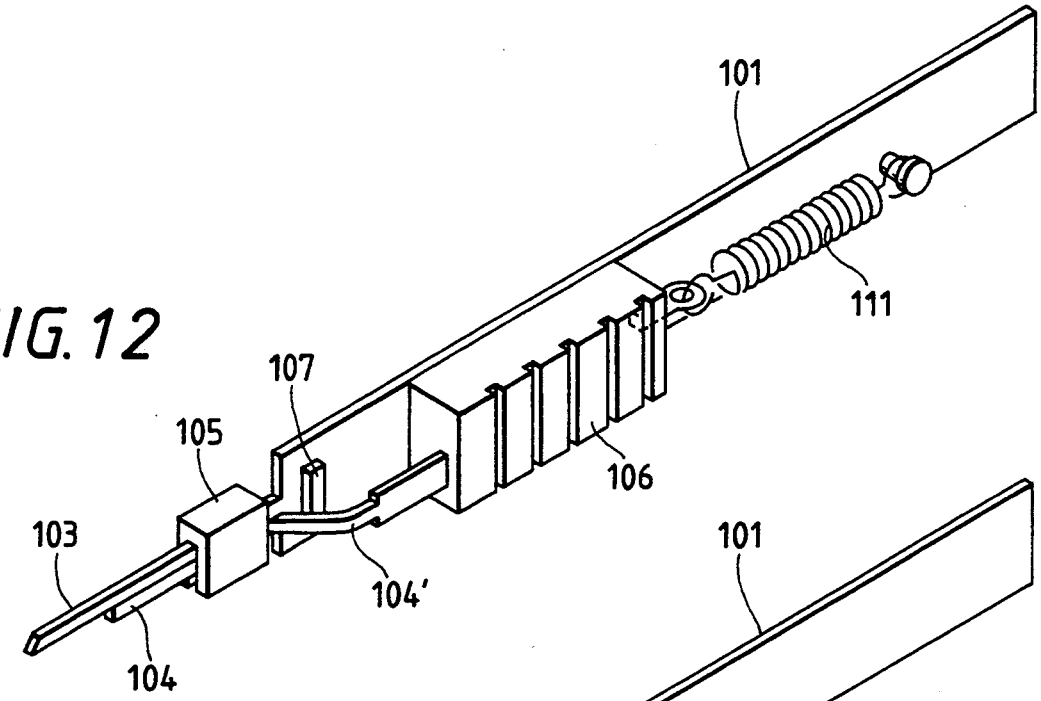
FIGS. 12, 13 and 14 are perspective views, each showing a modified jig based on the jig shown in FIG. 10.

FIG. 12 shows a modified embodiment of the present invention, in which a tensile coiled spring 111 for urging the manipulation member 106 backward is provided between the holder portion 101 and the manipulation member 106 so that the pushing member can be automatically returned to the original position.

Figure 13:
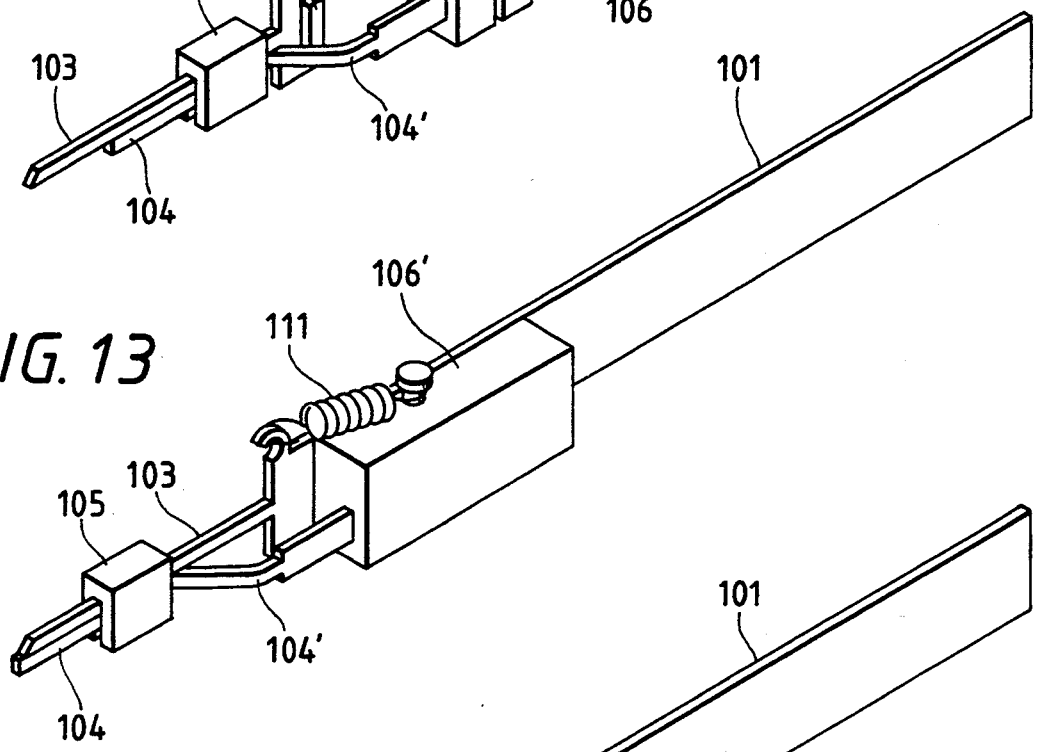

FIG. 13 shows another modified embodiment in which a tensile coiled spring 111 for urging the manipulation member 106' forward is provided between the holder portion 101 and a front portion of the coupling member 106'. In this modified embodiment, since the pushing member 104 is normally urged forward, the butting surface 104*a* of the pushing member 104 contacts the front end of the electric contact portion C1 immediately after the disengaging member 103 is inserted into the space 108, but the pushing member 104 is moved backward relative to the disengaging member 103 as proceeding the insertion of the disengaging member 103. Then, when the engagement between the flexible engagement piece 109 and the metal terminal C is released by the disengaging member 103, the pushing member 104 is moved forward by the elastic returning force of the coiled spring 111 energized by the backward movement of the pushing member 104 relative to the disengaging member 103. As a result, the metal terminal C is depressed by the pushing member 104 and can be automatically removed from the connector housing B. Therefore, in accordance with this embodiment, the jig A can be dispensed with a step of manually moving the pushing member 104 to depress the metal terminal C.

Figure 14:
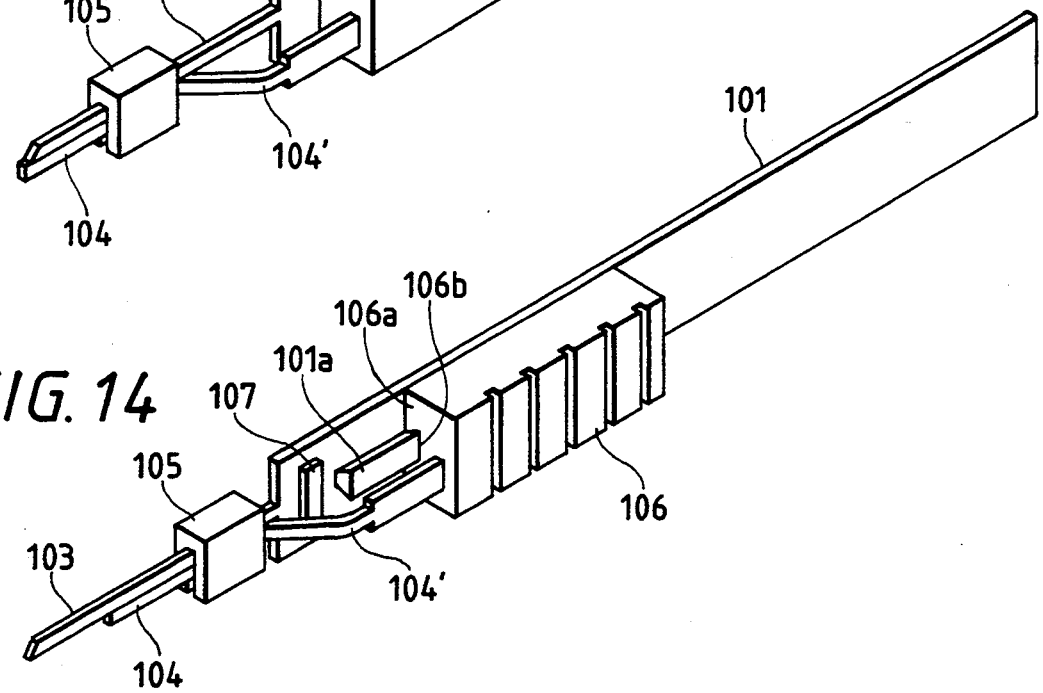

FIG. 14 shows a modified embodiment of the present invention, in which a guide projection 101*a* and a guide groove 106*b* engaged therewith are provided on the outer surface of the holder portion 101 and the inner surface of the manipulation member 106, respectively, so that the manipulation member is slidingly movable relative to the holder portion 101.

Figure 15A:
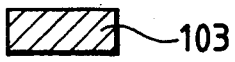
FIG. 15A is a cross sectional view showing a disengaging member.
Figure 15B:
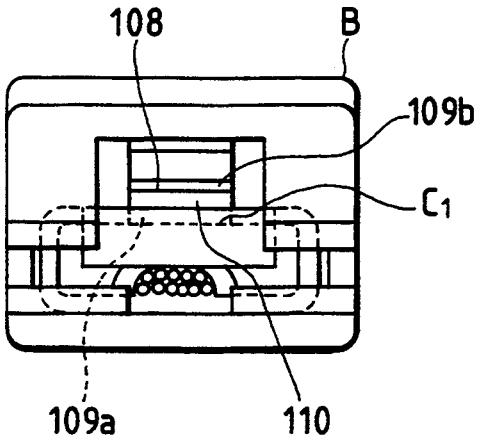
FIG. 15B is a front view showing a connector.

FIG. 15A shows a cross sectional shape of the disengaging member 103. As shown in FIG. 15B, the cross sectional shape of the disengaging member 103 is formed correspondingly to a cross sectional shape of the space 108 provided between the connector housing B and the electric contact portion C1 of the metal terminal C so that the insertion of the disengaging member 103 into the space 108 can be stabilized.

Figure 16A:
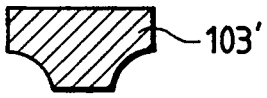
FIG. 16A is a cross sectional view showing another disengaging member.
Figure 16B:
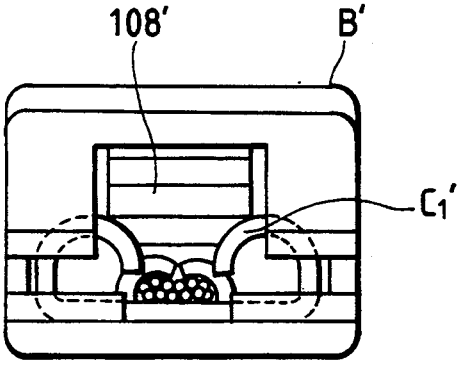
FIG. 16B is a front view showing another connector.

FIG. 16A shows another cross sectional shape of the disengaging member, which is modified to correspond to a cross sectional shape of the space 108 provided between the connector housing B' and the electric contact portion C1' of the metal terminal as shown in FIG. 16B.

The present invention is previously described along the embodiments, each of which is a jig for removing a female metal terminal from a connector housing, but the present invention is applicable to the device for removing a male metal terminal from a connector housing by modifying a front end of the pushing member to be engaged with the male metal terminal.

According to the present invention, when a metal terminal retained and held in a terminal accommodating chamber of a connector housing by a flexible engagement piece is removed therefrom, a terminal removal jig having a disengaging member and a pushing member is used such that the metal terminal is depressed and moved backward relative to the connector housing by the pushing member in a state that the flexible engagement piece is driven by the disengaging member to be disengaged from the metal terminal. Therefore, the removal operation of the metal terminal from the connector housing can be dispensed with conventional manners of directly grasping the wire extending from the metal terminal and pulling the wire so as to pull out the metal terminal from the connector housing. Thus, easier removable operation can be achieved.

What is claimed is:

1. A device for removing a metal terminal retained in a connector housing by a flexible engagement piece extending therefrom, comprising:

a disengaging member for disengaging said flexible engagement piece from said metal terminal;

a pushing member for urging said metal terminal from said housing; and support means for supporting said disengaging member and said pushing member so as to allow said disengaging member and said pushing member to be mutually moved, wherein said support means includes a holding portion having first and second individual chambers, a common chamber communicated with said first and second individual chambers and an opening communicated with said common chamber, said disengaging member being slidably fitted in said holding portion in such a manner that said disengaging member extends in said first individual chamber and said common chamber and projects outward through said opening.

2. The device according to claim 1, further comprising:

means for urging at least one of said disengaging member and said pushing member forward.

3. The device according to claim 1, wherein one of said disengaging member and said pushing member is stationary relative to said support means.

4. The device according to claim 1, wherein said pushing member is slidably fitted in said holding portion in such a manner that said pushing member extends in said second individual chamber and said common chamber and projects outward through said opening.

5. The device according to claim 4, further comprising:

a first buffer spring disposed in said first individual chamber for urging said disengaging member forward.

6. The device according to claim 4, further comprising:

a second buffer spring disposed in said second individual chamber for urging said pushing member forward.

7. The device according to claim 4, further comprising a first buffer spring disposed in said first individual chamber for urging said disengaging member forward; and a second buffer spring disposed in said second individual chamber for urging said pushing member forward.

8. The device according to claim 1, wherein said disengaging means includes a holding plate integral with said disengaging member.

9. A device for removing a metal terminal retained in a connector housing by a flexible engagement piece extending from the connector housing, comprising:

a disengaging member including a disengaging portion at one end thereof extending in a forward direction and an elongate holding plate including a holding portion adapted to be held in the palm of a user's hand with the user's thumb extending in said forward direction;

a pushing member slidably disposed along said holding plate of said disengaging member and including a pushing portion at one end thereof extending in said forward direction and a manipulating portion disposed forwardly of said holding portion so as to be moved by engagement with the user's thumb, wherein the terminal is removed from said connector housing by inserting said disengaging portion into said housing to disengage said engagement piece and, thereafter, moving said manipulation portion in said forward direction with the user's thumb to attendantly cause said pushing portion to push the terminal from the housing.

10. The device according to claim 9, further comprising:

means connected to said pushing member and said disengaging member for urging said pushing member backward.

11. The device according to claim 9, further comprising:

means connected to said pushing member and said disengaging member for urging said pushing member forward.

* * * * *